US007863819B2

(12) United States Patent
Hüttinger et al.

(10) Patent No.: US 7,863,819 B2
(45) Date of Patent: Jan. 4, 2011

(54) METAL HALIDE LAMP WITH ADHESIVE LAYER SEALING MOLYBDENUM/VANDIUM ALLOY LEADTHROUGH

(75) Inventors: Roland Hüttinger, Kaufering (DE); Stefan Jüngst, Zorneding (DE); Khanh Pham Gia, Neubiberg (DE); Steffen Walter, Oberpframmern (DE)

(73) Assignee: OSRAM Gesellschaft Mit Beschraenkter Haftung, Munich (DE)

( * ) Notice: Subject to any disclaimer, the term of this patent is extended or adjusted under 35 U.S.C. 154(b) by 0 days.

(21) Appl. No.: 12/086,076

(22) PCT Filed: Nov. 29, 2006

(86) PCT No.: PCT/EP2006/069038

§ 371 (c)(1),
(2), (4) Date: Feb. 5, 2009

(87) PCT Pub. No.: WO2007/065819

PCT Pub. Date: Jun. 14, 2007

(65) Prior Publication Data

US 2009/0134796 A1 May 28, 2009

(30) Foreign Application Priority Data

Dec. 9, 2005 (DE) ..... 10 2005 058 895

(51) Int. Cl.
*H01J 17/16* (2006.01)
*H01J 61/30* (2006.01)

(52) U.S. Cl. ..... 313/634; 313/484; 313/567; 313/638; 445/26

(58) Field of Classification Search ..... 313/484, 313/493, 567, 623–625, 634, 636, 637, 638, 313/318.01; 445/26–27
See application file for complete search history.

(56) References Cited

U.S. PATENT DOCUMENTS

| | | | | |
|---|---|---|---|---|
| 6,590,342 | B1 | 7/2003 | Onnekes-Van Der Voort et al. | |
| 2003/0141797 | A1 * | 7/2003 | Isida et al. | 313/284 |
| 2008/0284337 | A1 * | 11/2008 | Hendricx | 313/625 |

FOREIGN PATENT DOCUMENTS

| | | | |
|---|---|---|---|
| DE | 24 29 481 | A1 | 1/1975 |
| EP | 0 052 844 | A1 | 6/1982 |

* cited by examiner

*Primary Examiner*—Bumsuk Won
*Assistant Examiner*—Kevin Quarterman

(57) ABSTRACT

The invention relates to a metal halide lamp comprising a ceramic discharge vessel (10), characterized in that an MoV leadthrough is connected to a PCA element ($Al_2O_3$) by means of a specific adhesive layer containing Al and Mo.

6 Claims, 2 Drawing Sheets

METAL HALIDE LAMP WITH ADHESIVE LAYER SEALING MOLYBDENUM/VANDIUM ALLOY LEADTHROUGH

TECHNICAL FIELD

The invention relates to a metal halide lamp in accordance with the precharacterizing clause of claim 1. The invention is concerned with lamps with a ceramic discharge vessel which are used in particular in general lighting.

PRIOR ART

A metal halide lamp is already known from U.S. Pat. No. 6,590,342B. The leadthrough is sealed off by means of glass solder in a stopper. In order to adapt better to the coefficient of thermal expansion, a layer consisting of molybdenum aluminide, $Mo_3Al$, is applied to the leadthrough there. Other intermetallic components are also proposed for the layer.

The leadthrough is a pin, whose inner part consists of molybdenum. In this case, the layer also has the additional purpose of being particularly resistant to halogens in the filling.

DESCRIPTION OF THE INVENTION

The object of the present invention is to design the seal of the leadthrough to be as permanent as possible and to achieve improved adhesion between the leadthrough and the surrounding environment.

This object is achieved by the characterizing features of claim 1. Particularly advantageous configurations are provided in the dependent claims.

The sealing technology for high-pressure discharge lamps with a ceramic discharge vessel has not yet been satisfactorily resolved. For the seal, leadthroughs consisting of an MoV alloy and in the form of a tube or pin are now inserted directly into the end of a discharge vessel consisting of $Al_2O_3$. In this case, there is now no longer any need for a stopper consisting of a cermet, which consists of proportions of Mo and $Al_2O_3$.

Preferably, a tube is used as the leadthrough since it has more elastic properties than a pin. It is essential the leadthrough has an MoV part, it being possible for the leadthrough also to have other parts, for example a niobium part as the outer part or a core piece consisting of a different material. The MoV part is treated by means of an alitization process. Then, this system is inserted directly into the open end of a green body consisting of PCA. The PCA part is either a stopper or the direct end of a discharge vessel consisting of transparent $Al_2O_3$ or the like. It may possibly also be a cermet part consisting of the components Mo and $Al_2O_3$.

On the other hand, the interfacial joint between a molybdenum leadthrough, in particular a tube, and a stopper or end of the discharge vessel has been unsatisfactory with the previous technology using glass solder because the inert molybdenum does not enter into a reaction with glass solder. There is therefore only a physical bond with a poor adhesive action between a molybdenum leadthrough and a glass solder. During constant temperature changes between the operating state and the switched-off lamp, cracks therefore form which ultimately result in a lack of sealtightness and therefore in lamp failure.

According to the invention, no glass solder or melt ceramic is now provided at this point. A better adhesive action of the leadthrough in comparison with the PCA part, in particular the end of the ceramic discharge vessel, is achieved, possibly dispensing with a cermet stopper, by a special adhesive layer which is based on the activation of the surface of the leadthrough. By means of an alitization process, also referred to as an aluminum-coating process by means of spraying, aluminum is transferred reactively into the surface of the leadthrough consisting of molybdenum/vanadium alloy, in particular, via the gas phase. In this case, at first a layer with a high Al content, referred to more simply below as (MoV) 3Al8 layer, is formed. This takes place in a diffusion process, which is temperature-dependent and time-dependent. For this purpose, in particular MoV tubes are positioned in an Al-containing powder bed mixture and annealed at temperatures of between 800 and 1200° C. in a protective gas atmosphere. In this case, a gradient microstructure comprising an Al-rich AlxMoyVz phase, similar to an Al8Mo3 phase, which is adjoined further inwards by Al-leaner phases AlwMoyVz phase, similar to $MO_3Al$, which finally further inwards becomes the MoV microstructure of the tube, is produced on the outside in the surface of the leadthrough. In this case, the index w is significantly smaller then x. The aluminum from this outer phase near to the surface is capable of entering into a reaction with the oxygen of the PCA part, i.e. of the stopper or preferably of the end of the discharge vessel, which each predominantly consist of $Al_2O_3$ (PCA), during the direct sintering of the green body, in which shrinkage of the green body of the order of magnitude of approximately 10 to 30% is achieved, which provisionally seals off the leadthrough, as a result of the heat treatment during the direct sintering, and thereby providing a fixed joint between the stopper or end of the discharge vessel and the leadthrough. In this case, the adhesive layer is partially or completely converted into a cermet consisting of MoV and $Al_2O_3$.

In principle, this type of sealing can also be used for a system comprising the MoV part of the leadthrough and a cermet stopper consisting of Mo and $Al_2O_3$, with it being necessary to select the proportions of Mo:V differently than in the case of a pure $Al_2O_3$ stopper so as to match the coefficient of thermal expansion. However, the term PCA part is used below for all of these variants.

In this way, the seal between the MoV-containing leadthrough or the MoV part of the leadthrough and the PCA part, in particular stopper or end of the discharge vessel is decisively improved. Preferably, the adhesion partner is the direct end of the discharge vessel because then a simple and secure joint which is completely free of glass solder is possible, which allows for reliable sealing as a result of the combination of direct sintering-in with additional adhesive layer.

Particularly preferably, a protective gas consisting of inert gas such as in particular argon and/or nitrogen $N_2$, which in a particular embodiment contains a low proportion of from 20 to 200 ppm of oxygen $O_2$, is used during the direct sintering process. This improves the conversion in the adhesive layer. Depending on the procedure, the adhesive layer therefore either only partially or else more or less completely consists of a cermet consisting of Mo, V and $Al_2O_3$, it being possible for components of the initially present MoxAlyVz layers with a gradient microstructure to be maintained.

Since, when using unalloyed pure Mo tubes as the leadthrough as a result of the different coefficient of thermal expansion the formation of cracks arises after the sintering process despite good adhesion, an MoV alloy is used instead of Mo in the sealing region of the leadthrough. The alloy is set in such a way that its coefficient of thermal expansion is approximately $8\times10^{-6}\ K^{-1}$. It is therefore ideally matched to the so-called PCA, i.e. the polyceramic $Al_2O_3$. The alloy can, however, also be set in such a way that it is possible to match to a cermet stopper by increasing the Mo content.

MoV can be alitized just as well as pure Mo. In this case, the Al content of the alloy reacts sufficiently well to provide an adhesive layer. This alitization process is time-dependent and temperature-dependent, with the result that a gradient microstructure with relatively Al-rich and relatively Al-lean phases is at first formed in the adhesive layer.

The content of the vanadium in the molybdenum/vanadium alloy (MoV) should be below 50 wt % so as to match to pure PCA. A content of the vanadium in the range of from 20 to 40 wt % is preferred since in this case the relative differences in expansion can be kept sufficiently low. In the case of matching to a cermet consisting of Mo and $Al_2O_3$, the content of the vanadium should be markedly lower in the range of, for example, from approximately 8 to 25 wt % since the coefficient of thermal expansion of vanadium is of the order of magnitude of $9.6\times10^{-6}\ K^{-1}$. On the other hand, the coefficient of thermal expansion of molybdenum is markedly lower, at approximately $5.7\times10^{-6}\ K^{-1}$.

The good adhesion is achieved as a result of the temporary formation of an intermetallic microstructure, which is formed as a gradient structure from the Mo proportion of the base material of the leadthrough as far as into the ceramic. The formation of cracks, which until now have originated at the interface between the leadthrough/ceramic, is thereby markedly reduced.

The tube dimensions of the MoV-containing leadthrough can be conventional, as represented, for example, in EP-A 528 428. In particular, the leadthrough is preferably a tube with a diameter of 0.5 to 3 mm. The wall thickness is, for example, from 100 to 300 μm.

The "$(MoV)_3Al_8$" layer located on the outside on the leadthrough consisting of MoV or predominantly present there reacts at the high temperature of the direct sintering process of typically from 1700 to 1900° C. with the oxygen on the surface of the ceramic, with the result that the Al is converted into $Al_2O_3$ in this layer, an Al-leaner phase being produced from the original $(MoV)_3Al_8$. This cermet Mo—$Al_2O_3$ produced in the process forms, during its reaction, a toothed layer, which ensures particularly good adhesion. The reaction in the cermet stopper primarily proceeds on the surface of the larger grains of $Al_2O_3$, where the Al is very reactive.

The treatment for producing the reactive oxygen is facilitated in particular by using a protective gas during the direct sintering, consisting of an inert gas/oxygen mixture, whereby only small quantities of oxygen can be added to the inert gas, preferably argon and/or nitrogen. These are of the order of magnitude of a partial pressure of from 20 to 200 ppm, in particular at most 100 ppm. If more oxygen is added, the molybdenum oxidizes on the surface to form $MoO_2$ or $MoO_3$. These substances are very volatile and are not suitable for improving the adhesion.

FIGURES

The invention will be explained in more detail below with reference to a plurality of exemplary embodiments. In the figures.

DESCRIPTION OF THE PREFERRED EMBODIMENT

Figure 1:
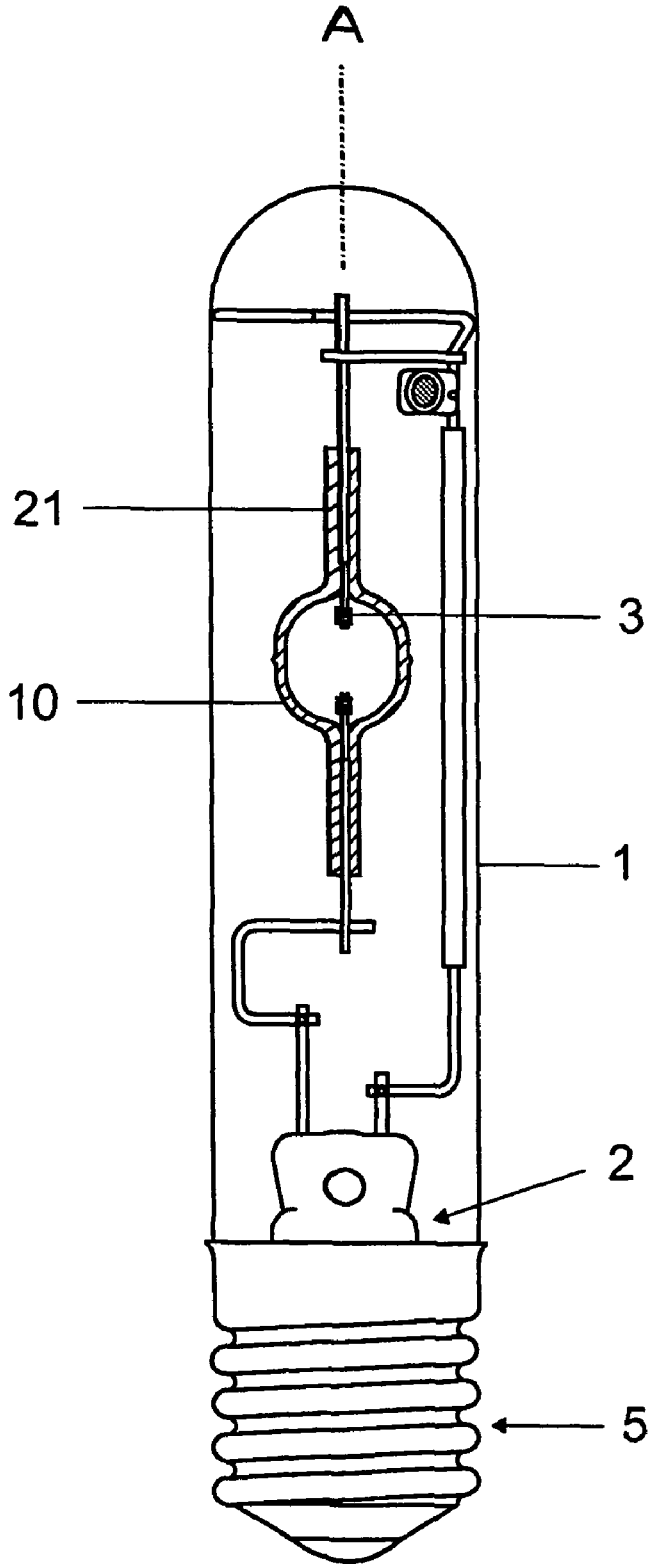
FIG. 1 shows a metal halide lamp, in section, schematically.

FIG. 1 shows a schematic of a metal halide lamp with an outer bulb 1 consisting of hard glass or quartz glass, which has a longitudinal axis and is sealed at one end by a plate-like fuse seal 2. Two power supply lines are passed out (not shown) at the plate-like fuse seal 2. They end in a base 5. A ceramic discharge vessel 10, which is sealed off at two ends, consists of $Al_2O_3$ (PCA) and has a filling consisting of metal halides is inserted axially in the outer bulb. The discharge vessel 10 can be cylindrical or internally spherical or elliptical with capillary ends 21.

Electrodes 3, which are fixed to leadthroughs consisting of MoV, protrude into the discharge vessel. The leadthrough is preferably a tube, but may also be a pin. In particular, the leadthrough can also be in two parts, and only the front end of the leadthrough can consist of MoV.

An ignitable gas from the group of noble gases is located in the discharge vessel. Furthermore, a mixture of metal halides as are known per se, for example iodides of Na, Tl and Dy and possibly mercury, is located in the discharge vessel. Ca can also be used as a halide.

Figure 2:
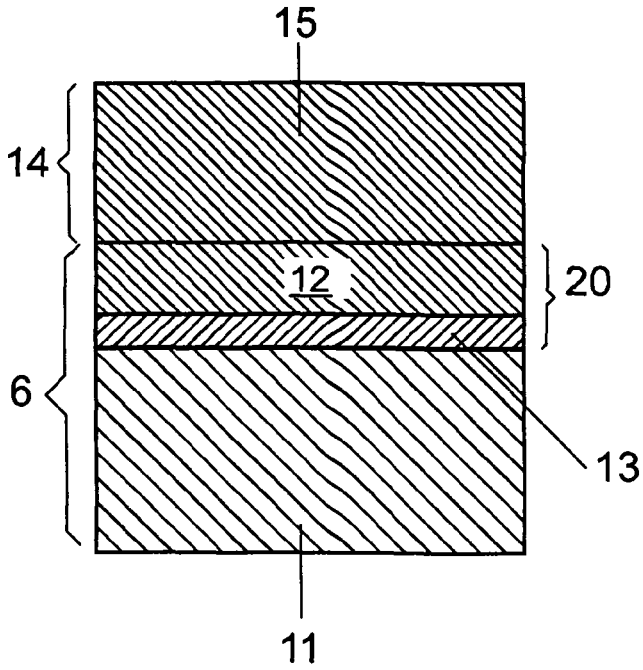
FIG. 2 shows an illustration of the joining mechanism, schematically.

FIG. 2 shows a schematic of the joint between the MoV tube and an $Al_2O_3$ stopper in detail. In this case, the leadthrough 6 consisting of a molybdenum/vanadium alloy with 30% by weight of vanadium is shown as a base material 11, with a thin first layer 12 of AlxMoyVz with a high proportion of Al being formed on the surface thereof. This layer is formed by an alitization process. Under suitably selected reaction conditions, the aluminum diffuses into deeper layers of the leadthrough, with the result that one or more thin layers 13 of AlxMoyVz are produced which contain a smaller proportion of Al, which is formed between the thin first layer and the base element consisting of MoV. This layer sequence is achieved by the diffusion of the aluminum into the surface of the MoV tube. The alitization takes place at from 700 to 1200° C. over a duration which is of the order of magnitude of a few hours. Depending on the procedure, up to six layers which can be analytically proven to be different and which can more or less continuously merge with one another are produced. A typical example is four layers, which have an average empirical formula for AlxMoyVz with the standardization x+y+z=1 of Al0.71V0.12Mo0.17 for the first layer, Al0.66V0.07Mo0.27 for the second layer, Al0.40V0.34Mo0.26 for the third layer and Al0.22V0.31Mo0.37 for the fourth layer.

The alitized MoV tube is now inserted into the green stopper and sintered directly. The aluminum from the layer located on the surface of the leadthrough, which layer consists of AlxMoyVz, reacts during direct sintering-in with the oxygen content of the stopper 14 consisting of $Al_2O_3$ with the result that a thin adhesive layer 20 is formed on the surface of the stopper over the base element 15. This is produced by partial or complete conversion of the intermetallic AlxMoyVz phases of the MoV tube and thus produces a permanent chemical bond. The layers 12, 13 from the intermetallic phases together form the novel adhesive layer 20, which partially, predominantly or completely consists of a cermet consisting of Mo and $Al_2O_3$.

In real terms, in this case no smooth interface is formed, but a gradual gradient is formed, with these layers merging with one another smoothly. In particular, the interface with the same concentration fluctuates suddenly, with the result that a narrow toothed formation is produced, similarly to as illustrated schematically in FIG. 3.

Figure 3:
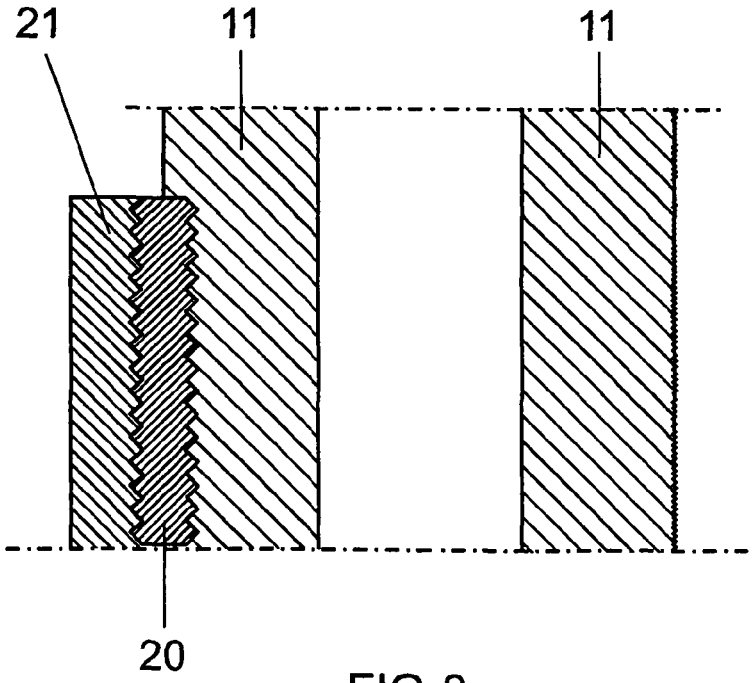
FIG. 3 shows a detail from FIG. 1, schematically.

FIG. 3 shows another exemplary embodiment, in which an MoV tube is inserted directly into the end 21 of a ceramic discharge vessel. It is held therein by direct sintering, in a similar manner to that described in FIG. 2. In this case, the leadthrough is represented as an MoV tube 11, to which the end 21 is connected on the outside via the novel adhesive layer 20. The toothed formation is in this case not illustrated to scale.

The leadthrough in this case does not need to completely consist of molybdenum/vanadium alloy. It is sufficient if it consists partially of MoV, in the part to be sealed. For example, a rear part of the leadthrough can consist of niobium, as is known per se, or the MoV part can have a core consisting of a different material, as is likewise known per se.

The PCA part, in which the leadthrough is directly sintered in, can be a stopper, or the end of the discharge vessel, or else another intermediate part, for example. PCA stands for polyceramic $AL_2O_3$, as is known per se.

The invention claimed is:

1. A metal halide lamp, which comprises a light-permeable ceramic discharge vessel consisting of $Al_2O_3$ (PCA), leadthroughs protruding into the discharge vessel through openings at its ends, each leadthrough manufactured to at least partially include an MoV part which comprises molybdenum/vanadium alloy, and bearing an electrode, the leadthrough being sealed off in the opening, wherein the MoV part of the leadthrough is sealed off in a PCA part via an adhesive layer, which adhesive layer comprises both Al and Mo.

2. The metal halide lamp as claimed in claim 1, characterized in that the adhesive layer partially comprises intermetallic layers, each of the form $Al_xMo_yV_z$, in which the sum of x+y+z is substantially equal to one, and wherein the proportions of Al, Mo and V in each layer vary between layers.

3. The metal halide lamp as claimed in claim 1, wherein the leadthrough is a tube.

4. The metal halide lamp as claimed in claim 1, wherein the leadthrough is joined to the PCA part, wherein the PCA part either a stopper or directly the end of the discharge vessel.

5. The metal halide lamp as claimed in claim 1, wherein the adhesive layer partially or completely comprises a cermet, which cermet contains Mo, V and $Al_2O_3$.

6. A method for producing a metal halide lamp as claimed in claim 1, a joint between a PCA part and the MoV part of the leadthrough being achieved by the following steps: (a) by means of an alitization process Al is diffused into the surface of the MoV part; (b) the alitized MoV part is inserted into the PCA part (c) direct sintering of the MoV part with heat treatment, with an adhesive layer being formed in the region of the alitization.

* * * * *